US006936192B2

(12) United States Patent
Urano

(10) Patent No.: US 6,936,192 B2
(45) Date of Patent: Aug. 30, 2005

(54) RESISTIVE COMPOSITION, RESISTOR USING THE SAME, AND MAKING METHOD THEREOF

(75) Inventor: Kouichi Urano, Minowa-machi (JP)

(73) Assignee: Koa Kabushiki Kaisha, Ina (JP)

( * ) Notice: Subject to any disclaimer, the term of this patent is extended or adjusted under 35 U.S.C. 154(b) by 156 days.

(21) Appl. No.: 10/663,679

(22) Filed: Sep. 17, 2003

(65) Prior Publication Data

US 2004/0061096 A1 Apr. 1, 2004

(30) Foreign Application Priority Data

Sep. 26, 2002 (JP) ..... 2002-281035

(51) Int. Cl.[7] ..... H01B 1/02; H01C 7/00; H01C 13/00; B05D 5/12

(52) U.S. Cl. ..... 252/512; 338/22 R; 427/101; 427/201

(58) Field of Search ..... 252/512, 518.1; 338/22 R; 427/101, 192, 201

(56) References Cited

U.S. PATENT DOCUMENTS 4,434,084 A * 2/1984 Hicks et al. ..... 252/512
4,894,184 A * 1/1990 Fukuoka et al. ..... 252/512
6,787,068 B1 * 9/2004 Mears ..... 252/512

FOREIGN PATENT DOCUMENTS

JP 2001-143901 A 5/2001
JP 2002-50501 A 2/2002

* cited by examiner

*Primary Examiner*—Mark Kopec
(74) *Attorney, Agent, or Firm*—Smith Patent Office

(57) ABSTRACT

A resistive paste is made by a mixture of a conductive metal powder which is made by mixing 85 to 94 percent by weight of copper powder, 5 to 10 percent by weight of manganese powder, and 1 to 5 percent by weight of tin powder; a mixture of 3 to 7 percent by weight of glass powder and 3 to 7 percent by weight of copper-oxide powder relative to the entire amount of said conductive metal powder; and 7 to 15 percent by weight of vehicle relative to the entire amount of the conductive metal powder and the mixture. The resistive paste is then sintered, and the resistive composition having the low resistance value and low TCR may be obtained. In addition, a resistor is made by forming the resistive element upon a substrate.

21 Claims, 2 Drawing Sheets

RESISTIVE COMPOSITION, RESISTOR USING THE SAME, AND MAKING METHOD THEREOF

BACKGROUND OF THE INVENTION

1. Field of the Invention

The present invention relates to a resistive composition to be used for a resistor to detect electric currents that flow in the current detecting circuits or the like, a resistor using the same, and a making method thereof.

2. Description of the Related Art

With a reduction in the size of the electronic apparatus, electronic components, especially chip components used in such apparatus have been required to be more compact in size. For the purpose of detecting electric currents that flow in the electronic circuits and/or power circuits of an equipment or the like, chip components having low resistance value and low temperature coefficient of resistance (TCR) have been needed.

Conventional resistors have used resistive element such as silver (Ag)-palladium (Pd), or copper (Cu)-nickel (Ni) alloy so as to obtain the low resistance characteristic. Some resistors use wire rods made of copper (Cu)-manganese (Mn)-tin (Sn), or materials obtained by processing the wire rods into a foil, which are a resistive material having a low resistivity and low temperature coefficient of resistance, as disclosed in, for example, Laid-open Japanese Patent Application No. 2001-143901.

A current detecting chip resistor, which uses as a resistive composition copper-nickel alloy, copper-manganese-tin based alloys, or the like, and which controls deterioration of electric current detection accuracy due to the resistor temperature variation, has been proposed and, for example, is disclosed in Laid-open Japanese Patent Application No. 2002-50501.

In the case of the above-mentioned resistive element made of silver-palladium alloy contains no cadmium. However, since the binder glass contains lead, which is a harmful substance, environmental problems will arise. In the case of commercially available resistive element comprising above-mentioned elements, its characteristics are determined by itself.

A resistor utilizing copper-manganese-tin based alloys as disclosed in Laid-open Japanese Patent Application No. 2001-143901 uses lead as a cladding material, therefore, that resistor causes environmental problems like the above-mentioned resistive element does.

As with a chip resistor using copper-nickel alloy or the like as a resistive element, as disclosed in Laid-open Japanese Patent Application No. 2002-50501, in the case of copper-nickel composition resistive element, since the intrinsic property of copper, namely, its resistance value and the TCR (temperature coefficient of resistance) is dominant, the TCR increases as the resistance value decreases. Due to this, the resistive element cannot obtain the desired property (electric current detection precision).

Such examples show the following properties. When the copper-nickel composition is 60:40, the sheet resistance is 35 mΩ/□, and the TCR is $50\times10^{-6}$/k. Additionally, when the copper-nickel composition is 90:10, the sheet resistance is 15 mΩ/□, and the TCR is $1200\times10^{-6}$/K.

This invention is provided by taking the above-mentioned problems into account; its objective is to provide a low TCR resistive composition having low resistance value and containing no substance which is harmful to the environment, a resistor using the same, and making method thereof.

SUMMARY OF THE INVENTION

The following configuration is provided as an example of a means for achieving the objectives and solving the above-mentioned problems. Namely, the resistive composition according to the present invention includes: a conductive metal powder containing at least either a first mixed powder, an alloy powder, or a second mixed powder, the first mixed powder being made of copper powder, manganese powder, and tin powder, the alloy powder being made of copper, manganese, and tin, and the second mixed powder being made of the first mixed powder and the alloy powder; glass powder; copper-oxide powder; and vehicle containing resin and solvent.

The following configuration is also provided as an example of a means for achieving the objectives and solving the above-mentioned problems. Namely, the resistive composition according to the present invention includes: a mixture of a conductive metal powder made by mixing 85 to 94 percent by weight of copper powder, 5 to 10 percent by weight of manganese powder, and 1 to 5 percent by weight of tin powder; a mixture of 3 to 7 percent by weight of glass powder and 3 to 7 percent by weight of copper-oxide powder relative to the entire amount of the conductive metal powder; and 7 to 15 percent by weight of vehicle relative to the entire amount of the conductive metal powder and the mixture.

The following configuration is provided as an example of another means for solving the above-mentioned problems. Namely, a resistor using a resistive composition as a resistive element, wherein the resistive composition comprising a conductive metal powder containing at least either a first mixed powder, an alloy powder, or a second mixed powder, the first mixed powder being made of copper powder, manganese powder, and tin powder, the alloy powder being made of copper, manganese, and tin, and the second mixed powder being made of the first mixed powder and the alloy powder; glass powder; copper-oxide powder; and vehicle containing resin and solvent.

Furthermore, the following configuration is provided as a means of solving the above-mentioned problems. Namely, a resistor using a resistive composition as a resistive element, wherein the resistive composition is a mixture of a conductive metal powder made by mixing 85 to 94 percent by weight of copper powder, 5 to 10 percent by weight of manganese powder, and 1 to 5 percent by weight of tin powder; a mixture of 3 to 7 percent by weight of glass powder and 3 to 7 percent by weight of copper-oxide powder relative to the entire amount of the conductive metal powder; and 7 to 15 percent by weight of vehicle relative to the entire amount of the conductive metal powder and the mixture.

The following configuration is provided as an example of another means of solving the above-mentioned problems. Namely, a making method of a resistor according to the present invention includes: a first step of making a conductive metal powder by mixing 85 to 94 percent by weight of copper powder, 5 to 10 percent by weight of manganese powder, and 1 to 5 percent by weight of tin powder; a second step of making a mixture of 3 to 7 percent by weight of glass powder and 3 to 7 percent by weight of copper-oxide powder relative to the entire amount of the conductive metal powder obtained in the first step; and a third step of making 7 to 15 percent by weight of vehicle relative to the entire amount of the conductive metal powder and the mixture obtained in the first and second steps.

The following configuration is also provided as an example of another means of solving the above-mentioned problems. Namely, a making method of a resistor according to the present invention includes: a step of weighing metal components of copper, manganese, and tin; a step of forming a resistive element comprising a conductive metal powder which contains at least either a first mixed powder, an alloy powder, or a second mixed powder, the first mixed powder being made of copper powder, manganese powder, and tin powder, the alloy powder being made of copper, manganese, and tin, and the second mixed powder being made of the first mixed powder and the alloy powder; glass powder; copper-oxide powder; and vehicle containing resin and solvent; and a step of forming the resistive element upon an insulating substrate.

The following configuration is also provided as an example of another means of solving the above-mentioned problems. Namely, a making method of a resistor according to the present invention includes: a step of weighing metal components of copper, manganese, and tin; a step of forming a resistive element comprising a mixture of a conductive metal powder made by mixing 85 to 94 percent by weight of copper powder, 5 to 10 percent by weight of manganese powder, and 1 to 5 percent by weight of tin powder; a mixture of 3 to 7 percent by weight of glass powder and 3 to 7 percent by weight of copper-oxide powder relative to the entire amount of the conductive metal powder; and 7 to 15 percent by weight of vehicle relative to the entire amount of the conductive metal powder and the mixture; and a step of forming the resistive element upon an insulating substrate.

For example, the above-mentioned conductive metal powder, the glass powder, and the copper-oxide powder are free of lead and cadmium.

For example, the above-mentioned copper oxide is made of either CuO or $Cu_2O$.

DETAILED DESCRIPTION OF THE INVENTION

Figure 1:
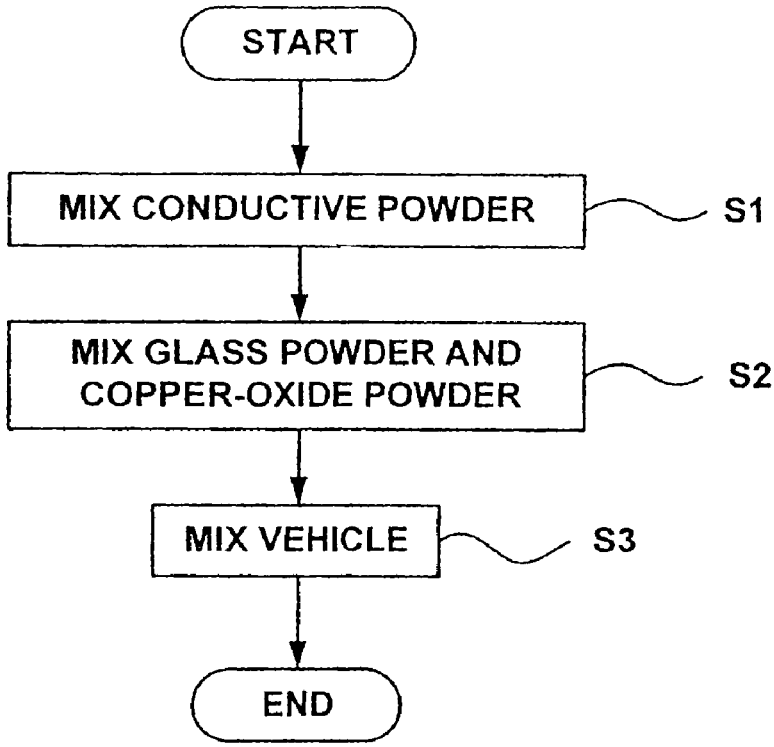
FIG. 1 is a flowchart showing a making process of the resistive paste according to an embodiment of the present invention.

An exemplary embodiment of the present invention is described in detail forthwith while referencing accompanied drawings and a table. In this embodiment, for example, the resistive paste, which is a resistive composition, is made of a conductive metal powder containing copper powder, manganese powder, and tin powder; a mixed powder made of, glass powder and copper-oxide powder to be mixed with the conductive metal powder; and vehicle including resin and solvent, and a resistor is made by using this resistive paste.

A conductive metal powder of the above-mentioned resistive paste is made by, for example, mixing 85 to 94 percent by weight of copper powder, 5 to 10 percent by weight of manganese powder, and 1 to 5 percent by weight of tin powder. It is preferable that the resistive paste is made by mixing 3 to 7 percent by weight of glass powder and 3 to 7 percent by weight of copper-oxide powder relative to the entire amount of the conductive metal powder, and furthermore by mixing 7 to 15 percent by weight of vehicle relative to the entire amount of the above-mentioned conductive metal powder and a mixture of the above-mentioned glass powder and copper-oxide powder.

Note that all of the powders and materials compounded in the resistive paste contains neither lead, which is harmful to the environment and a human body, nor cadmium (that is, cadmium-free). The copper powder and the like, which is a conductive metal material of the resistive paste, preferably has a particle diameter within an allowable range for screen printing onto a substrate described later. For example, the range of the particle diameter is preferably between 0.1 $\mu$m and 5 $\mu$m. More specifically, the average particle diameter is preferably 2 $\mu$m or less.

Instead of the mixed powder made of copper, manganese, and tin powders used in the resistive paste according to this embodiment, the copper-manganese-tin alloy powder may be used. In this case, the range of the particle diameter of the alloy powder is preferably between 0.1 $\mu$m and 5 $\mu$m, for example. More specifically, the average particle diameter is preferably 2 $\mu$m or less.

For the resistive paste according to this embodiment, a mixed powder made by mixing the mixed powder obtained by mixing copper, manganese, and tin powders with the alloy powder of copper, manganese, and tin may be used as a conductive metal powder.

In any of the case described above, if the ultimate combined mixture ratio of copper, manganese, and tin is the above-mentioned ratio, the desired property such as the resistance value and TCR of the resistive paste may be obtained.

The material suitable as the glass powder of the resistive paste according to this embodiment is preferably the one which has adhesion with an insulating substrate to form resistive layers using that resistive paste and various stabilities necessary for the resistive element. For example, a borosilicate barium based glass, a borosilicate calcium based glass, a borosilicate barium calcium based glass, a borosilicate zinc based glass, a zinc borate based glass, or the like may be used as the glass powder.

In addition, the particle diameter of the glass powder is preferably within the allowable range for screen printing, for example, the particle diameter is preferably between 0.1 $\mu$m and 5 $\mu$m. More specifically, the average particle diameter is preferably 2 $\mu$m or less.

In this embodiment, the material suitable as the copper oxide of the copper-oxide powder preferably has adhesiveness with the insulating substrate to form the resistive layer using the resistive paste, and various stabilities necessary for the resistive element. For example, both CuO (copper oxide) and $Cu_2O$ (copper monoxide) may be used. In addition, the particle diameter of the copper-oxide powder is preferably within the allowable range for screen printing, for example, the particle diameter is preferably between 0.1 $\mu$m and 5 $\mu$m; more specifically, the average particle diameter is preferably 2 $\mu$m or less.

Meanwhile, as a resin to be used for vehicle made of resin and solvent of the resistive paste according to this embodiment, for example, cellulosic resin, acrylic resin, alkyd resin, or the like may be used. More specifically, for example, ethyl cellulose, ethyl acrylate, butyl acrylate, ethyl methacrylate, butyl methacrylate, or the like may be possible.

In addition, for example, a terpene based solvent, an ester alcohol based solvent, an aromatic hydrocarbon based solvent, an ester based solvent, or the like may be used as the solvent to be used for the vehicle made of resin and solvent of the resistive paste. More specifically, for example, terpineol, dihydroterpineol, 2,2,4-trimethyl-1,3-pentanediol, texanol, xylene, isopropylbenzene, toluene, acetic acid diethylene glycol monomethyl ether, acetic acid diethylene glycol monoethyl ether, acetic acid diethylene glycol monobutyl ether, or the like may also be possible.

Note that the configuration of the vehicle is not limited to the above-mentioned resin and solvent, but various additives may be added in order to improve the resistive paste characteristics.

It is possible to perform fine adjustment on the resistive paste characteristics according to this embodiment, which depends upon compounding ratios of each of the above-mentioned powders. Accordingly, the products using such resistive paste become wider in their properties. For example, the most suitable compounding ratio of the powders for obtaining the desired property is as follows.

In this embodiment, 5 percent by weight of glass powder, and 5 percent by weight of copper-oxide powder are mixed with the compound made of Cu:Mn:Sn=90:7:3 (percent by weight). 12 percent by weight of vehicle is then mixed with the obtained compound. The resistive paste obtained by this compounding ratio has properties where the sheet resistance (40 $\mu$m in layer thickness) is 15 mΩ/□, and the TCR is $100\times10^{-6}$/K.

FIG. 1 illustrates a making process of the resistive paste, which is a resistive composition according to this embodiment. In step S1 in the drawing, the conductive metal powders of copper, manganese, and tin used as the conductive metal material of the resistive paste are mixed.

A specific compounding ratio of such conductive metal powder is, as described above, for example, 85 to 94 percent by weight of copper powder, 5 to 10 percent by weight of manganese powder, and 1 to 5 percent by weight of tin powder are mixed. In the case where the compound made of Cu:Mn:Sn=90.7:7:2.3 (percent by weight) is mixed with 5 percent of borosilicate zinc glass, 5 percent of $Cu_2O$, and 12 percent of vehicle, then heated and sintered in a nitrogen ($N_2$) atmosphere at, for example, 960° C. for 10 minutes, the conductive metal powder itself has the characteristics that the resistance is 29 mΩ at 20° C.

By utilizing the above-mentioned material (copper-manganese-tin powder) instead of conventional copper-nickel resistive element, for example, the resistive paste according to this embodiment adjusts the intrinsic characteristics of copper using other materials.

In the following step S2, a borosilicate zinc glass powder as the glass powder and $Cu_2O$ powder as the copper-oxide powder are mixed with the conductive metal powder mixed in the above step S1. That is, 3 to 7 percent by weight of glass powder not containing lead (lead-free glass powder) and 3 to 7 percent by weight of copper-oxide powder are mixed relative to the entire amount of Cu—Mn—Sn conductive metal powder.

In this way, the resistive paste according to this embodiment applies a lead-free glass to the glass for the binder so as to make the resistive paste lead-free.

In step S3, the vehicle is mixed. In this step, 7 to 15 percent by weight of vehicle made of organic resin and solvent is mixed relative to the entire amount to which the above-mentioned Cu—Mn—Sn conductive metal powder, glass powder and copper-oxide powder are mixed.

TABLE 1

| Sample No. | | 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|
| Compounding Ratio (wt %) | Cu wt % | 85 | 85 | 85 | 85 | 85 | 90 | 90 | 90 | 90 | 90 | 94 | 94 | 94 | 94 |
| | Mn wt % | 15 | 14 | 12 | 10 | 5 | 10 | 9 | 7 | 5 | 0 | 6 | 5 | 3 | 1 |
| | Sn wt % | 0 | 1 | 3 | 5 | 10 | 0 | 1 | 3 | 5 | 10 | 0 | 1 | 3 | 5 |
| | borosilicate zinc glass wt % | 5 | 5 | 5 | 5 | 5 | 5 | 5 | 5 | 5 | 5 | 5 | 5 | 5 | 5 |
| | $Cu_2O$ wt % | 5 | 5 | 5 | 5 | 5 | 5 | 5 | 5 | 5 | 5 | 5 | 5 | 5 | 5 |
| | Vehicle wt % | 12 | 12 | 12 | 12 | 12 | 12 | 12 | 12 | 12 | 12 | 12 | 12 | 12 | 12 |
| Sheet Resistance mΩ/□ | | 25 | 25 | 20 | 15 | 20 | 5 | 10 | 15 | 10 | 10 | 5 | 5 | 4 | 3 |
| TCR × $10^{-6}$/K | | 300 | 300 | 200 | 300 | 300 | 400 | 100 | 100 | 200 | 400 | 400 | 300 | 400 | 400 |
| Completed resistance mΩ | | 50 | 50 | 40 | 30 | 40 | 10 | 20 | 30 | 20 | 20 | 10 | 10 | 8 | 6 |
| Remarks | | (b) | (b) | (b) | (a) | (c) | (d) | (a) | (a) | (a) | (d) | (d) | (a) | (d) | (d) |

(a): Attained target values
(b): Poor surface condition
(c): Having a large resistance
(d): Having a large TCR Table 1 shows examples of the specific compounding ratio and the characteristics of the resistive paste according to this embodiment. In this embodiment, the sheet resistance, temperature coefficient of resistance (TCR), and completed resistance of the resistive paste (sample Nos. 1 to 14) are measured, when the resistive paste is made by mixing the above-mentioned Cu—Mn—Sn metal powder, the glass powder made of a borosilicate zinc glass, the copper-oxide powder made of $Cu_2O$, and vehicle.

Note that the sheet resistance is measured for a test pattern of 1 mm×1 mm×20 $\mu$m (sintered film thickness), and TCR and completed resistance are measured for a chip size of 3.2 mm×1.6 mm.

With respect to the resistive paste according to this embodiment, target value of TCR is set to less than $350\times10^{-6}$/K, target value of the completed resistance is set to less than 30 mΩ (10 to 30 mΩ). As a result of this, 5 samples with sample Nos. 4, 7 to 9, and 12 marked with (a) in the remarks column in the table 1 have attained these target values. Other samples have been decided to be defective because they have not flat surface and have a large TCR.

Figure 2:
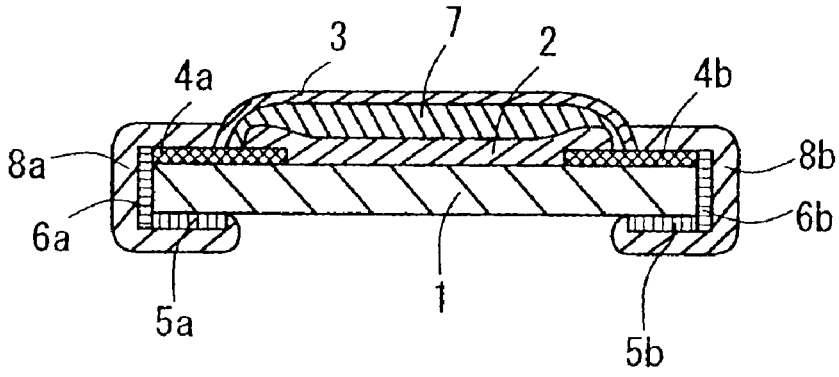
FIG. 2 is a diagram showing a cross-sectional configuration of a chip resistor according to the embodiment.

FIG. 2 shows a cross-sectional configuration of an example of a flat-type chip resistor (hereafter, simply referred to as a chip resistor) using the resistive paste according to this embodiment. In the drawing, a substrate 1 is, for example, an electrically insulating ceramics substrate (insulating substrate) having a chip shape with a predetermined size. A resistive layer 2 is formed upon the substrate 1 by coating the resistive paste made by compounding the powder having the above-mentioned component through screen printing, for example, and then sintering thereof.

The top of the resistive layer 2 is coated and protected by a pre glass 7. Furthermore, a protective film 3 functioning as an insulating film is provided upon the pre glass 7. On both ends of the substrate 1 and under both ends of the resistive layer 2 are formed upper electrodes (surface electrodes) 4*a* and 4*b*, which have electrical contact therewith. In addition, lower electrodes (backside electrodes) 5*a* and 5*b* are formed at the ends of the substrate bottom. In order to electrically connect the upper electrodes 4*a* and 4*b* and lower electrodes 5*a* and 5*b*, end electrodes 6*a* and 6*b* are disposed between those electrodes at each side end of the substrate 1.

Furthermore, an external electrode 8*a* is formed through plating so as to cover at least one part of the upper electrode 4*a*, the lower electrode 5*a* and end electrode 6*a*. Similarly, an external electrode 8*b* is formed through plating so as to cover at least one part of the upper electrode 4*b*, the lower electrode 5*b* and end electrode 6*b*.

For example, alumina substrate, forsterite substrate, mullite substrate, aluminum nitride substrate, glass ceramics substrate, or the like may be used as an insulating substrate for such resistor.

In addition, mixed powder in which metal powders of copper, manganese, and tin are mixed in the above-mentioned ratio, or alloy powder of copper, manganese, and tin is used as the main conductive metal components of the resistive layer 2. To use mixture of copper, manganese, and tin powders, they are alloyed during sintering.

Figure 3:
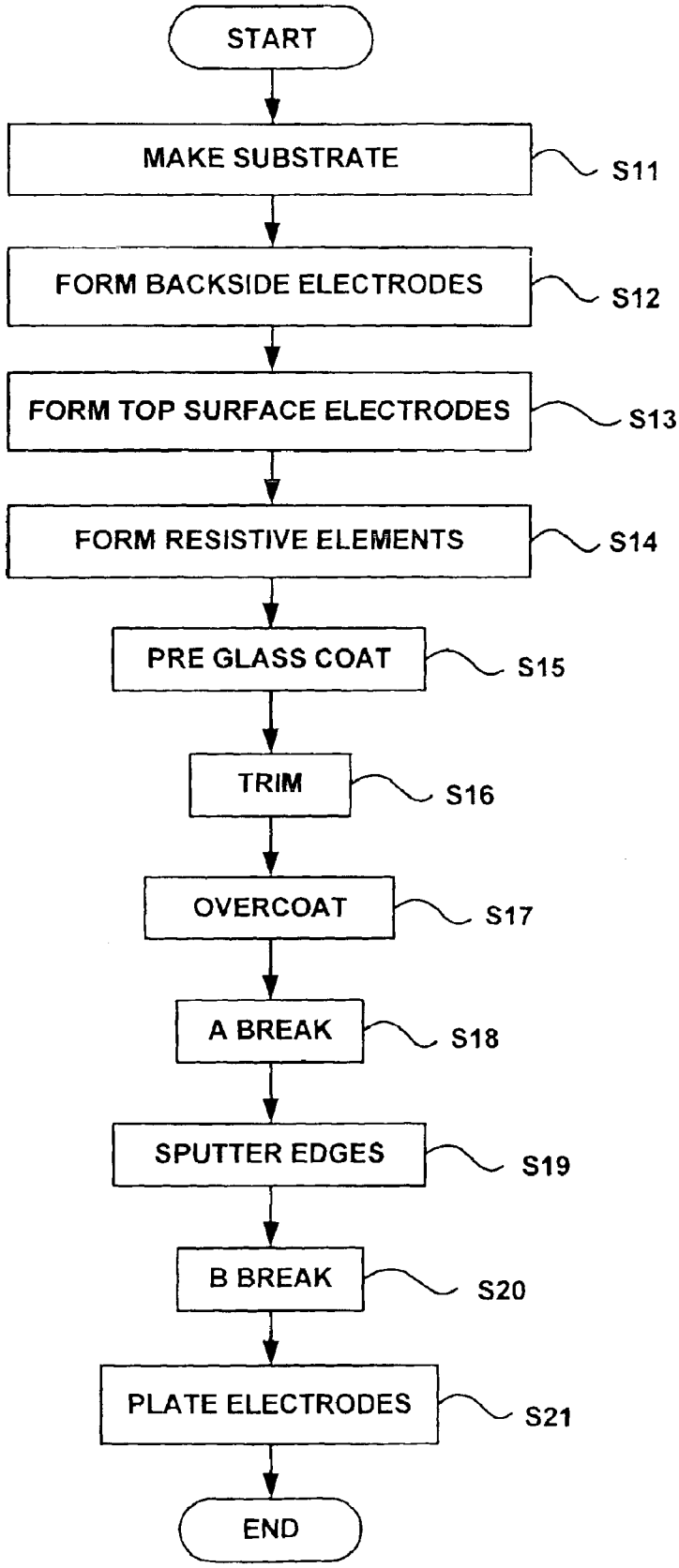
FIG. 3 is a process diagram for describing a making process of a resistor according to the embodiment.

Next, a making process of a resistor according to this embodiment comprising the above-mentioned configuration is described. FIG. 3 is a process diagram for describing the making process of the resistor according to this embodiment. To begin with, in step S11 of FIG. 3, a process of making the above-mentioned substrate 1 is performed. Note that the alumina substrate containing 96 wt % alumina is used as the substrate.

As the shape of the substrate, for example, a rectangular substrate with a size that is equal to that of a predetermined making unit size is made, however, an arbitrary size of the substrate may be made, thereo re, substrates each having the size that corresponds to each resistor, or substrates each having the size that corresponds to a plurality of resistors may be made at the same time.

In the following step S12, the lower electrodes (backside electrodes) 5*a* and 5*b* are formed upon the bottom (solder side when mounting the resistor) of the substrate 1 through thick-film printing by screen printing and sintering of the backside electrodes. More specifically, the backside electrodes are formed by printing copper paste (Cu paste) onto the back side of the alumina substrate, then drying it, and sintering it in the nitrogen ($N_2$) atmosphere at, for example, 960° C. for 10 minutes.

Next, in step S13, upper electrodes (surface electrodes) 4*a* and 4*b* are formed upon the top surface (on which the resistor element is to be formed) of the substrate 1 through thick-film printing by screen printing and sintering of the top side electrodes. More specifically, the surface electrodes are formed by printing copper paste on the top side of the alumina substrate, then drying it, and sintering it in the nitrogen atmosphere at, for example, 960° C. for 10 minutes.

Note that the upper electrodes (surface electrodes) 4*a* and 4*b*, and lower electrodes (backside electrodes) 5*a* and 5*b* may be baked simultaneously.

With this embodiment, a problem of reliability degradation due to the electronic migration of silver is prevented by using copper paste as an electrode material, as the conventional resistor, for performing thick-film printing on both the back side and the top side. Also, sintering in the nitrogen ($N_2$) atmosphere, or, inert atmosphere, is totp vent oxidation of copper electrodes. Note that the sintering temperature is not limited to 960° C., but other than that temperature, for example, sintering at 980° C. is also possible.

In step S14, for example, the resistive paste thick film is formed by coating the above-mentioned resistive paste between the upper electrodes (surface electrodes) 4*a* and 4*b* so that a portion of the paste is overlapped with the upper electrodes (surface electrodes) 4*a* and 4*b*. This resistive paste thick film is then baked in the nitrogen ($N_2$) atmosphere at 960° C., for example. Note that the sintering temperature may also be 980° C.

In this embodiment, by adding copper oxide to the resistive paste, it is possible to obtain good adhesion between the substrate and resistive element; and with a glass (for example, a ZnBSiOx glass), it is possible to obtain the intensity of inorganic binder film. Furthermore, the vehicles function so as to provide printability using the organic binder.

In step S15, a pre glass-coated thick film is formed through printing, or the like upon the resistive layer 2 which is formed in the above manner, and then dried and baked. In this case, for example, the pre glass coat is formed by printing the ZnBSiOx based glass paste upon the resistive element, then drying it, and finally sintering it in the nitrogen atmosphere at, for example, 670° C. for 10 minutes.

Note that the sintering temperature may also be 690° C. In addition, the glass paste is not limited to the ZnBSiOx based glass paste, but the above-mentioned borosilicate barium based glass, borosilicate calcium based glass, borosilicate barium calcium based glass, borosilicate zinc based glass, or zinc borate based glass may also be used.

Next, in step S16, trimming the resistive element (adjustment of resistance value) is performed if necessary. Through this trimming, the resistance value is adjusted by slotting or slitting the resistive element pattern by using, for example, a laser beam or sandblast.

In step S17, for example, an overcoat, which is the protective layer 3 having a function as the insulating layer, is formed by forming epoxy resin through screen printing so as to cover the pre glass coat and a part of upper electrodes 4*a* and 4*b*, and then hardening thereof.

The display section for displaying a resistance value and the like is then formed by printing the epoxy resin upon the overcoat (protective layer 3) as needed, and then hardening thereof.

Furthermore, in step S18, an A break (primary break) is performed to separate the alumina substrate into strips. In the following step S19, the end electrodes 6*a* and 6*b* are formed by forming NiCr alloy (thin film) layers on the edges of the strip alumina substrate through the use of sputtering technique. Note that formation of the NiCr alloy layer is not limited to sputtering, but may also be formed through vacuum evaporation technique, or the like.

In step S20, a B break (secondary break) is then performed, and the strip alumina substrate on which the end electrodes 6*a* and 6*b* have already been formed, is further divided into chips. The size of the obtained chips is, for example, 3.2 mm×1.6 mm.

In step S21, the external electrodes 8*a* and 8*b* are formed upon the portion of the upper electrodes 4*a* and 4*b* that is not covered by the protective layer 3, the lower electrodes 5*a* and 5*b*, and the end electrodes 6*a* and 6*b*.

For example, the external electrodes 8*a* and 8*b* are electrolytic nickel (Ni) plated, electrolytic copper (Cu) plated, electrolytic nickel (Ni) plated, and electrolytic tin (Sn) plated in order, that is, a Ni layer-Cu layer-Ni- layer and Sn layer are stacked.

The resistor having 3.2 mm×1.6 mm chip size made as described above is formed so as to have, for example, a 470 μm substrate thickness, 20 μm top side electrode thickness, 20 μm lower side electrode thickness, 30 to 40 μm resistive layer thickness, 10 μm pre glass coat thickness, 30 μm protective layer thickness, 0.05 μm end electrode thickness; and 3 to 7 μm Ni layer thickness, 20 to 30 μm Cu layer thickness, 3 to 12 μm Ni layer thickness, and 3 to 12 μm Sn layer thickness as the external electrode thicknesses in order.

With a method of sintering the resistive paste and post-sintering resistive element when making a resistor by using the resistive paste of this embodiment, the resistive paste is preferably baked in the neutral atmosphere or inert atmosphere (for example, in the nitrogen atmosphere) at 600 to 1000° C. Note that the sintering time of the above-mentioned resistive paste may be set arbitrarily. Accordingly, a copper-manganese-tin based resistive element, more preferably a copper-manganese-tin alloy resistive element, may be obtained.

As described above, according to the present invention, by mixing, as material of the resistive paste, the conductive metal powder such as copper-manganese-tin (Cu—Mn—Sn), lead-free glass powder and copper-oxide powder, it is possible to obtain the resistive paste not containing a harmful substance to the environment such as lead and cadmium, and having a low resistance value and low TCR.

It is also possible to fine adjust properties of the resistive paste in accordance with compounding ratio of each powder, therefore the resistive paste becomes wider in its resistance value and TCR by, for example, adjusting ratio of the powder when the paste is made.

In addition, since a chip resistor using the resistive paste and having a high reliability and high efficiency can be made, that chip resistor may become the chip resistor that is most appropriate for an application, such as a resistor (shunt resistor) for detecting electric currents that flow in the power circuit, motor circuit and the like.

While the invention has been described with reference to particular example embodiments, further modifications and improvements which will occur to those skilled in the art, may be made within the purview of the appended claims, without departing from the scope of the invention in its broader aspect.

What is claimed is:

1. A resistive composition comprising:

a conductive metal powder containing at least either a first mixed powder, an alloy powder, or a second mixed powder, said first mixed powder being made of copper powder, manganese powder, and tin powder, said alloy powder being made of copper, manganese, and tin, and said second mixed powder being made of said first mixed powder and said alloy powder;

glass powder;

copper-oxide powder; and vehicle containing resin and solvent.

2. The resistive composition according to claim 1, wherein said conductive metal powder, said glass powder, and said copper-oxide powder are free of lead and cadmium.

3. The resistive composition according to claim 1, wherein said copper oxide is made of either CuO or $Cu_2O$.

4. A resistive composition comprising:

a mixture of a conductive metal powder made by mixing 85 to 94 percent by weight of copper powder, 5 to 10 percent by weight of manganese powder, and 1 to 5 percent by weight of tin powder; a mixture of 3 to 7 percent by weight of glass powder and 3 to 7 percent by weight of copper-oxide powder relative to the entire amount of said conductive metal powder; and 7 to 15 percent by weight of vehicle relative to the entire amount of said conductive metal powder and said mixture.

5. The resistive composition according to claim 4, wherein said conductive metal powder, said glass powder, and said copper-oxide powder are free of lead and cadmium.

6. The resistive composition according to claim 4, wherein said copper oxide is made of either CuO or $Cu_2O$.

7. A resistor using a resistive composition as a resistive element, wherein said resistive composition comprising a conductive metal powder containing at least either a first mixed powder, an alloy powder, or a second mixed powder, said first mixed powder being made of copper powder, manganese powder, and tin powder, said alloy powder being made of copper, manganese, and tin, and said second mixed powder being made of said first mixed powder and said alloy powder; glass powder; copper-oxide powder; and vehicle containing resin and solvent.

8. The resistor according to claim 7, wherein said conductive metal powder, said glass powder, and said copper-oxide powder are free of lead and cadmium.

9. The resistor according to claim 7, wherein said copper oxide is made of either CuO or $Cu_2O$.

10. A resistor using a resistive composition as a resistive element, wherein said resistive composition is a mixture of a conductive metal powder made by mixing 85 to 94 percent by weight of copper powder, 5 to 10 percent by weight of manganese powder, and 1 to 5 percent by weight of tin powder; a mixture of 3 to 7 percent by weight of glass powder and 3 to 7 percent by weight of copper-oxide powder relative to the entire amount of said conductive metal powder; and 7 to 15 percent by weight of vehicle relative to the entire amount of said conductive metal powder and said mixture.

11. The resistor according to claim 10, wherein said conductive metal powder, said glass powder, and said copper-oxide powder are free of lead and cadmium.

12. The resistor according to claim 10, wherein said copper oxide is made of either CuO or $Cu_2O$.

13. A making method of a resistive composition, comprising:

a first step of making a conductive metal powder by mixing 85 to 94 percent by weight of copper powder, 5 to 10 percent by weight of manganese powder, and 1 to 5 percent by weight of tin powder;

a second step of making a mixture of 3 to 7 percent by weight of glass powder and 3 to 7 percent by weight of copper-oxide powder relative to the entire amount of said conductive metal powder obtained in said first step; and a third step of making 7 to 15 percent by weight of vehicle relative to the entire amount of said conductive metal powder and said mixture obtained in said first and second steps.

14. The making method of the resistive composition according to claim 13, wherein said conductive metal powder, said glass powder, and said copper-oxide powder are free of lead and cadmium.

15. The making method of the resistive composition according to claim 13, wherein said copper oxide is made of either CuO or $Cu_2O$.

16. A making method of a resistor, comprising:

a step of weighing metal components of copper, manganese, and tin;

a step of forming a resistive element comprising a conductive metal powder which contains at least either a first mixed powder, an alloy powder, or a second mixed powder, said first mixed powder being made of copper powder, manganese powder, and tin powder, said alloy powder being made of copper, manganese, and tin, and said second mixed powder being made of said first mixed powder and said alloy powder; glass powder; copper-oxide powder; and vehicle containing resin and solvent; and a step of forming said resistive element upon an insulating substrate.

17. The making method of the resistor according to claim 16, wherein said conductive metal powder, said glass powder, and said copper-oxide powder are free of lead and cadmium.

18. The making method of the resistor according to claim 16, wherein said copper oxide is made of either CuO or $Cu_2O$.

19. A making method of a resistor, comprising:

a step of weighing metal components of copper, manganese, and tin;

a step of forming a resistive element comprising a mixture of a conductive metal powder made by mixing 85 to 94 percent by weight of copper powder, 5 to 10 percent by weight of manganese powder, and 1 to 5 percent by weight of tin powder; a mixture of 3 to 7 percent by weight of glass powder and 3 to 7 percent by weight of copper-oxide powder relative to the entire amount of said conductive metal powder; and 7 to 15 percent by weight of vehicle relative to the entire amount of said conductive metal powder and said mixture; and a step of forming said resistive element upon an insulating substrate.

20. The making method of the resistor according to claim 19, wherein said conductive metal powder, said glass powder, and said copper-oxide powder are free of lead and cadmium.

21. The making method of the resistor according to claim 19, wherein said copper oxide is made of either CuO or $Cu_2O$.

* * * * *